US007380551B2

(12) United States Patent
Alvey

(10) Patent No.: US 7,380,551 B2
(45) Date of Patent: Jun. 3, 2008

(54) BREATHING APPARATUS

(75) Inventor: Jeffrey A. Alvey, Union Bridge, MD (US)

(73) Assignee: TVI Corporation, Glenn Dale, MD (US)

( * ) Notice: Subject to any disclaimer, the term of this patent is extended or adjusted under 35 U.S.C. 154(b) by 0 days.

(21) Appl. No.: 10/933,555

(22) Filed: Sep. 3, 2004

(65) Prior Publication Data

US 2005/0022817 A1 Feb. 3, 2005

Related U.S. Application Data

(63) Continuation of application No. 10/393,346, filed on Mar. 21, 2003.

(51) Int. Cl.
*A62B 7/10* (2006.01)

(52) U.S. Cl. ..... 128/201.25; 128/202.22; 128/204.26; 128/205.22; 128/205.23

(58) Field of Classification Search ..... 128/201.25, 128/202.22, 204.26, 205.22, 205.23
See application file for complete search history.

(56) References Cited

U.S. PATENT DOCUMENTS 2,085,249 A 6/1937 Bullard ..... 128/145
2,284,054 A * 5/1942 Siegwart ..... 128/204.25
2,332,662 A 10/1943 Nathanson
2,450,446 A * 10/1948 Rupp ..... 251/117
2,484,217 A * 10/1949 Gardenier ..... 600/532
2,787,782 A * 4/1957 Rosenblum et al. ..... 250/574
2,817,350 A * 12/1957 Bradner et al. ..... 137/87.04
2,818,860 A * 1/1958 Holm et al. ..... 128/202.22
2,828,741 A * 4/1958 Delest ..... 128/202.22
2,998,009 A * 8/1961 Holm et al. ..... 128/204.19
2,999,497 A 9/1961 Hamilton et al. ..... 128/142
3,000,805 A 9/1961 Carritt et al.
3,092,104 A * 6/1963 Cassidy ..... 128/202.22
3,106,205 A * 10/1963 Caldwell ..... 128/202.22
3,202,150 A 8/1965 Miller ..... 128/142
3,250,873 A * 5/1966 Kudlaty et al. ..... 200/83 L
3,252,458 A * 5/1966 Krasberg ..... 128/204.22
3,410,778 A * 11/1968 Krasberg ..... 204/414

(Continued)

FOREIGN PATENT DOCUMENTS

DE 195 03 027 A1 * 3/1996

(Continued)

OTHER PUBLICATIONS

Wilcox Industries Corp., SCOUT System description, updated, Wilcox Industries Corp., Portsmouth, NH, no date.

(Continued)

*Primary Examiner*—Steven O. Douglas
(74) *Attorney, Agent, or Firm*—Whiteford, Taylor & Preston; Jeffrey C. Maynard; Gregory M. Stone

(57) ABSTRACT

An improvement to a combination of an SCBA system for providing bottled air to a user and a PAPR system for purifying ambient air for use by a user wherein a sensor is included to determine the oxygen content of the breathing gas and the presence of contaminations in the atmosphere to control operation of the two systems depending on the contaminated condition of the ambient air and the oxygen content of the ambient air.

20 Claims, 7 Drawing Sheets

U.S. PATENT DOCUMENTS

| | | | | | |
|---|---|---|---|---|---|
| 3,456,642 | A | * | 7/1969 | Cupp | 128/204.26 |
| 3,508,542 | A | * | 4/1970 | Browner | 128/202.22 |
| 3,556,098 | A | * | 1/1971 | Kanwisher et al. | 128/202.22 |
| 3,587,438 | A | * | 6/1971 | Foster et al. | 454/70 |
| 3,657,740 | A | | 4/1972 | Cialone | |
| 3,739,774 | A | | 6/1973 | Gregory | 128/142.7 |
| 3,773,044 | A | * | 11/1973 | Wallace | 128/202.22 |
| 3,805,590 | A | * | 4/1974 | Ringwall et al. | 73/24.01 |
| 3,896,837 | A | * | 7/1975 | Rohling | 137/110 |
| 3,911,413 | A | * | 10/1975 | Wallace | 340/632 |
| 3,957,044 | A | * | 5/1976 | Fletcher et al. | 128/202.22 |
| 4,019,507 | A | | 4/1977 | Oetjen et al. | |
| 4,121,578 | A | * | 10/1978 | Torzala | 128/204.23 |
| 4,127,122 | A | * | 11/1978 | Kienhofer et al. | 128/201.25 |
| 4,146,887 | A | * | 3/1979 | Magnante | 340/632 |
| 4,233,972 | A | | 11/1980 | Hauff et al. | |
| 4,250,876 | A | * | 2/1981 | Kranz | 128/202.22 |
| 4,273,120 | A | * | 6/1981 | Oswell | 128/204.26 |
| 4,417,575 | A | | 11/1983 | Hilton et al. | 128/206.19 |
| 4,419,994 | A | | 12/1983 | Hilton | 128/206.19 |
| 4,423,723 | A | | 1/1984 | Winkler et al. | |
| 4,430,995 | A | * | 2/1984 | Hilton | 128/204.21 |
| 4,440,162 | A | | 4/1984 | Sewell et al. | |
| 4,440,463 | A | | 4/1984 | Gliha, Jr. et al. | |
| 4,462,399 | A | | 7/1984 | Braun | |
| 4,463,755 | A | | 8/1984 | Suzuki | 128/204.18 |
| 4,510,193 | A | | 4/1985 | Blucher et al. | 428/196 |
| 4,567,889 | A | | 2/1986 | Lehmann | 128/204.28 |
| 4,572,323 | A | | 2/1986 | Randall | 181/129 |
| 4,590,951 | A | * | 5/1986 | O'Connor | 128/204.23 |
| 4,612,239 | A | | 9/1986 | Dimanshteyn | 428/246 |
| 4,633,868 | A | * | 1/1987 | Itoh et al. | 128/204.26 |
| 4,676,236 | A | * | 6/1987 | Piorkowski et al. | 128/201.23 |
| D295,046 | S | | 4/1988 | Odell | D15/7 |
| 4,741,332 | A | * | 5/1988 | Beaussant | 128/201.23 |
| 4,765,326 | A | | 8/1988 | Pieper | |
| 4,841,953 | A | | 6/1989 | Dodrill | |
| 4,873,970 | A | * | 10/1989 | Freidank et al. | 128/202.22 |
| 4,886,056 | A | | 12/1989 | Simpson | |
| 4,887,638 | A | | 12/1989 | Hellquist et al. | 137/505.13 |
| 4,899,740 | A | | 2/1990 | Napolitano | |
| 4,905,683 | A | | 3/1990 | Cronjaeger | |
| 4,926,855 | A | | 5/1990 | Hellquist et al. | 128/201.28 |
| 4,971,052 | A | | 11/1990 | Edwards | 128/205.12 |
| 5,018,518 | A | * | 5/1991 | Hubner | 128/202.22 |
| 5,035,239 | A | | 7/1991 | Edwards | 128/205.23 |
| 5,080,414 | A | | 1/1992 | Hellquist et al. | 294/31.1 |
| 5,097,826 | A | | 3/1992 | Gray et al. | |
| 5,112,666 | A | | 5/1992 | Langston | 428/104 |
| 5,115,804 | A | * | 5/1992 | Brookman | 128/201.22 |
| 5,125,402 | A | | 6/1992 | Greenough | |
| 5,161,525 | A | | 11/1992 | Kimm et al. | |
| 5,221,572 | A | | 6/1993 | Meunier | 428/231 |
| 5,265,592 | A | | 11/1993 | Beaussant | 128/201.24 |
| 5,322,058 | A | * | 6/1994 | Pasternack | 128/204.28 |
| 5,323,774 | A | * | 6/1994 | Fehlauer | 128/206.12 |
| 5,370,112 | A | * | 12/1994 | Perkins | 128/204.21 |
| 5,390,666 | A | | 2/1995 | Kimm et al. | |
| 5,413,097 | A | * | 5/1995 | Birenheide et al. | 128/206.17 |
| 5,461,934 | A | | 10/1995 | Budd | |
| 5,577,496 | A | * | 11/1996 | Blackwood et al. | 128/201.25 |
| 5,584,286 | A | | 12/1996 | Kippax | 128/200.24 |
| 5,611,485 | A | | 3/1997 | Davis | |
| 5,626,947 | A | | 5/1997 | Hauer et al. | 428/195 |
| 5,660,171 | A | | 8/1997 | Kimm et al. | |
| 5,666,949 | A | * | 9/1997 | Debe et al. | 128/202.22 |
| 5,743,775 | A | | 4/1998 | Baurmeister | 442/77 |
| 5,758,641 | A | * | 6/1998 | Karr | 128/204.22 |
| 5,832,916 | A | | 11/1998 | Lundberg | 128/202.22 |
| 5,848,591 | A | * | 12/1998 | Weismann | 128/204.22 |
| 5,906,203 | A | * | 5/1999 | Klockseth et al. | 128/205.24 |
| 5,915,834 | A | * | 6/1999 | McCulloh | 366/151.1 |
| 5,950,621 | A | * | 9/1999 | Klockseth et al. | 128/204.26 |
| 5,964,218 | A | * | 10/1999 | Smith et al. | 128/201.25 |
| 6,102,034 | A | | 8/2000 | Buhlmann | 128/201.29 |
| 6,105,632 | A | | 8/2000 | Buhlmann | 141/18 |
| 6,167,882 | B1 | | 1/2001 | Almqvist et al. | 128/201.27 |
| 6,186,140 | B1 | * | 2/2001 | Hoague | 128/202.22 |
| 6,269,811 | B1 | | 8/2001 | Duff et al. | |
| 6,290,111 | B1 | | 9/2001 | Hedenberg et al. | 224/262 |
| 6,328,031 | B1 | | 12/2001 | Tischer et al. | 128/201.25 |
| 6,360,741 | B2 | | 3/2002 | Truschel | |
| 6,360,742 | B1 | | 3/2002 | Maxwell et al. | 128/202.27 |
| 6,626,175 | B2 | | 9/2003 | Jafari et al. | |
| 7,077,133 | B2 | | 7/2006 | Yagi et al. | |

FOREIGN PATENT DOCUMENTS

| | | |
|---|---|---|
| EP | 0 094 757 A2 | 11/1983 |
| EP | 0 241 188 A1 | 10/1987 |
| FR | 814750 | 6/1937 |
| FR | 886782 | 10/1943 |
| FR | 2 514 934 | 4/1983 |
| GB | 2 025 316 A | 1/1980 |
| GB | 1 587 812 | 4/1981 |
| WO | WO 00/57738 | 10/2000 |

OTHER PUBLICATIONS

Wilcox Industries Corp., offer to sell Wilcox SCOUT System, Aug. 23, 2002, Wilcox Industries Corp., Portsmouth, NH.

Wilcox Industries Corp., Invoice No. 2328-0104-00, Dec. 31, 2002, Wilcox Industries Corp., Portsmouth, NH.

* cited by examiner

BREATHING APPARATUS

CROSS REFERENCE TO RELATED APPLICATION

This application is a continuation of co-pending U.S. patent application Ser. No. 10/393,346 entitled "Powered Air Purifying Respirator System and Self Contained Breathing Apparatus", filed with the U.S. Patent and Trademark Office on Mar. 21, 2003, the specification of which is incorporated herein by reference.

BACKGROUND OF THE INVENTION

1. Field of the Invention

This invention is directed to an apparatus for assisting persons to breathe in hostile environments. It more particularly relates to such an apparatus that is useful in purifying contaminated air as well as providing portable clean air.

2. Background of the Prior Art

There are, at present two systems for assisting the breathing of persons who are subject to contaminated air. First, there are the supplied air systems, such as Self Contained Breathing Apparatus (SCBA) that feed compressed air (e.g. bottled) to a tight fitting facemask, or other conduit to the mouth and/or nose, for inhaling by a user. These systems do not permit the user access to the ambient atmosphere at all. Second, there are filter/decontamination systems for use in the form of a canister, in connection with a respirator apparatus that rely on cleaning ambient atmosphere to make it suitable for breathing. Such filter systems may or may not make use of auxiliary power. In powered systems, ambient atmosphere is sucked through a suitable filter/decontamination means, or other purifying means, by a powered fan or the like, such that the contaminated ambient air is rendered breathable. The purified resultant air is fed to a headpiece of some kind, such as a tight fitting facemask. The complete system is known as a Powered Air Purifying Respirator (PAPR). Both types of breathing assists are used by personnel who are subject to breathing ambient atmosphere that would otherwise be considered to be harmfully contaminated, un-breathable, or dangerous air.

A dangerous or un-breathable atmosphere is considered to be air containing less than 19.5 volume percent oxygen, or air with the requisite oxygen, but also containing significant proportions of harmful contaminants, e.g. particulate or gaseous. It will be appreciated that, in some situations, (where the oxygen content is at least 19.5%), a wearer may be able to enter an area that has a contaminated atmosphere using only a filter system, provided the filter(s) is capable of meeting the challenge of the contamination, as a result cleaning the atmosphere and enabling the user to breath and still preserve his health. The filter can be provided with means to eliminate harmful constituents in the wearer's ambient atmosphere. In particular, filter based decontamination systems, that is, those systems that purify an ambient atmosphere that has become contaminated so as to convert it to breathable air, work best when they pass an air supply under positive pressure through a cleaning element (such as a suitable filter). That is, a pump/fan is used to suck the contaminated atmosphere through a filter, and perhaps into contact with a material that ameliorates the contaminant(s), and to then force the purified, e.g. filtered, air under positive pressure into a facemask or other means associated with the breathing of the wearer, such as a mouth grip, hood, or helmet. While a powered air supplying means, such as a battery operated pump/fan, is probably preferred, it is also known that air cleaning systems that are not powered by external means can be used. In these unpowered systems, the user's lung power provides the necessary impetus to force contaminated air through the cleaning element and feed it to the user. For simplicity, this means of cleaning ambient atmosphere will be referred to as an Air Purifying Respirator (APR). When the air is forced through the system due to the use of a battery, line current or other powered pump or fan arrangement, the operating system is known as a Powered Air Purifying Respirator (PAPR).

A powered air purifying respirator system (PAPR) will protect against contaminants so long as the oxygen level in the purified air is above 19.5 volume percent and provided the contaminants are such as can be removed by filtration, e.g. soot and smoke, and/or can be ameliorated by reaction with a suitable purifying material. In practical effect, these systems have been designed to use replaceable filter(s) and air purifying canister(s). However, they are of no value where the ambient atmosphere has an oxygen content that is less than 19.5% by volume.

Other situations exist, such as where the ambient atmosphere is so contaminated, or the contamination is such, that a filter and/or decontamination/purifier system cannot handle the problem; and/or the oxygen content of the ambient air is too low to satisfy human survival needs (that is, where the atmosphere is IDLH, that means the ambient atmosphere is of Immediate Danger to Life and Health). In those circumstances, a person entering the area with such level and type of contamination must take his own air supply along with him. This is akin to a SCUBA diver carrying his air with him in the form of a container (bottle) with compressed, clean air in it.

One problem is that a wearer of a SCBA must support all of the weight of the bottled air whereas, in water, a diver has the advantage of the water's buoyancy to help support the weight of the SCUBA tanks. Even so, most SCBA systems are only capable of carrying enough bottled, compressed air for up to about an hour's use. It would, of course, be most desirable to be able to increase the time that a user, for example a fire fighter, can work in a hostile environment dependent upon bottled air while at the same time minimizing the weight that the person must carry to support him for that additional time.

It will be appreciated that air bottles are heavy, especially when they are full. In the case of fire fighters, they are already going into an unfriendly environment carrying their tools with them, and the heat of the fire makes it even more difficult to carry the extra weight of the compressed air container. Further, the fire fighter must often proceed, from the safe ambient air outside the area where a fire has merely contaminated the atmosphere to an extent such that it can be cleaned, by wearing some form of APR, for a relatively long distance before he reaches an area where the contamination is of such an extent that the atmosphere cannot be reasonably cleaned and where he must breath the air he brought with him, or strangle from lack of oxygen, or be harmed by other contaminants.

When carrying around ones' own air supply, there is a very real practical limit as to how much air can be safely carried. Contrary to operating under water with a SCUBA rig, the air bottles used by fire fighters are quite heavy, must be supported entirely by the wearer, and do not have the advantage of water buoyancy partially supporting their weight. Making them larger, to be able to carry more air, increases their weight but decreases their portability. This combination of weight and working conditions severely limits the time that a fire fighter, who is wearing/carrying his own air supply and tools, can effectively fight the fire.

Thus, there exists a situation in which a fire fighter, for example, does not need carried air for some portion of the time that he is working on the fire, but does need portable, bottled air for other portions of the time that he is working on the fire. Yet, existing systems are suited to one or the other; that is, the existing systems either provide positive pressure (pumped) filtering and purification systems to convert contaminated ambient atmosphere to air that is clean enough to breath safely, or they provide bottled air under pressure that is carried by the person to be used instead of the ambient atmosphere. While both systems have deficiencies, each system has advantages, even necessities, under critical conditions.

The above and following comments use a fire fighter as illustrative of the type of person who will benefit from using the instant invention. However, this invention is by no means limited in use to fire fighters. Workers in chemical plants and refineries will have substantial need for the benefits available from the instant invented system. Soldiers in the field that are being subjected to chemical or biological attack will benefit greatly from the instant system. It will be apparent to those of ordinary skill in this art that others will similarly be assisted by the instant invention

SUMMARY OF THE INVENTION

The present invention provides a solution to the above and other problems by enabling a combination powered air purifying respirator and supplied air respirator system for supplying clean, breathable air from either ambient surroundings of from a source of compressed air to a respirator hood or facemask.

It is therefore an object of this invention to provide a hybrid assisted breathing apparatus that has the advantages of both the SCBA and the PAPR systems.

Other and additional objects of this invention will become apparent from a consideration of this entire specification.

In accord with and fulfilling this object, one aspect of this invention is a breathing assisting apparatus comprising a tight fitting facemask, or other conventional means of bringing respirating air to a person in need thereof, that is adapted to be tightly fitted to a person's face or mouth or nose (or any combination thereof). For ease of understanding, further reference will be made to the use of a facemask. However, this use is illustrative and not limiting. A mouthpiece can also serve the function of bringing the breathable air to the user.

Under complete manual operation, the PAPR and SCBA are each connected to the facemask by its own breathing hose, each with its own entry point, in the case of a dual entry facemask, or, via a "tee" piece, or similar connection device in the case of a single entry facemask. At or about the facemask each is provided with a non-return (one-way) valve. An exhaust valve is provided in the facemask so that exhaust air is vented to the atmosphere. A valving and/or switching system is provided so that the wearer controls whether to receive cleaned ambient air or supplied (bottled) air. This valving and/or switching system can be manually operated by the user, in which case the user determines, independently, which air supply to use; or it can operate under semi-automatic control via sensors where the air supply from the SCBA and the PAPR are both connected to a valve manifold. On start up, the SCBA supply is in a shut off condition and the PAPR is in an on condition. Air is passed to the facemask via the PAPR. Either at the discretion of the wearer or in response to an audible and/or visual alarm that operates based on sampling and testing the ambient air and indicates by way of the alarm that the system should be switched from PAPR to SCBA operation; the wearer opens the SCBA supply valve and then switches off the PAPR. The pressure of the SCBA air, on exhaust, will operate valves automatically switching off the PAPR leaving the air supply solely on the SCBA. In the alternative, the decision as to whether to accept purified air from the canister/filter assembly, or to demand air from the supplied air bottle, can operate automatically based on sampling and testing of the ambient air and associated automatic controls of the valves which would be electrically operated so as to open access to the SCBA and close access to the PAPR in response to predetermined environmental conditions.

At least one air bottle is provided with a connection to at least one port in the facemask and a controllable valve is provided that permits control as to whether to withdraw air from the bottle(s). At least one filter or canister is provided, separate from the air bottle(s), also with a controllable valve system that permits control as to whether ambient air is taken in by the PAPR and fed to the mask. A battery or other powered electric motor driven fan that is operatively attached between the filter or canister and a hose to the user, is provided with a control device, such as a switch or a handle, to selectively enable operation of the motor driven fan.

Thus, when the ambient air has sufficient oxygen content, and the contaminants are suited to removal by filtration or treatment in the canister, the fan can be activated by operating the switch and ambient air will be powered through the filter or canister where it is purified of its harmful constituents, such as soot and other harmful particles, vapors or gases. Under manual operation when the ambient air has insufficient oxygen, or the contaminants are such that they cannot be removed by filtration or other treatment in the filter(s) or canister(s), the wearer opens the valve of the SCBA, and the PAPR is switched off. Ambient air is no longer taken in through the filter(s)/canister(s). Instead, breathing air is supplied by the SCBA.

Where a facemask is used, it is suitably equipped with a one-way valve that enables exhausted, exhaled air to be vented regardless whether the intake air was derived through the filter canister or from the bottled compressed air. It is considered to be within the scope of this invention for it to be used in conjunction with a closed circuit apparatus.

As is conventional, the bottled air, which is under substantial pressure, must have its pressure reduced to an extent sufficient to enable it to be breathed by the user without damage to the user's respiratory system. This procedure, and equipment to enable this to be accomplished, is well known per se. Suitably, commercially available first and second stage regulators can be used for this purpose. Thus, there are in effect two successive valving systems disposed between the air bottle and the facemask: a first valve that is a simple open or close valve that is attached at or very near the air bottle; and a regulator, pressure reducing valving system that is disposed in the line between the first valve and the facemask.

An example of a combined SCBA and APR is shown in U.S. Pat. No. 3,202,150, issued Jun. 11, 1962 and an example of a combined SCBA and PAPR is shown in European Patent Application Publication EP 0 241 188 A1, dated 14 Oct. 1987, the specifications of each are incorporated herein by reference.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
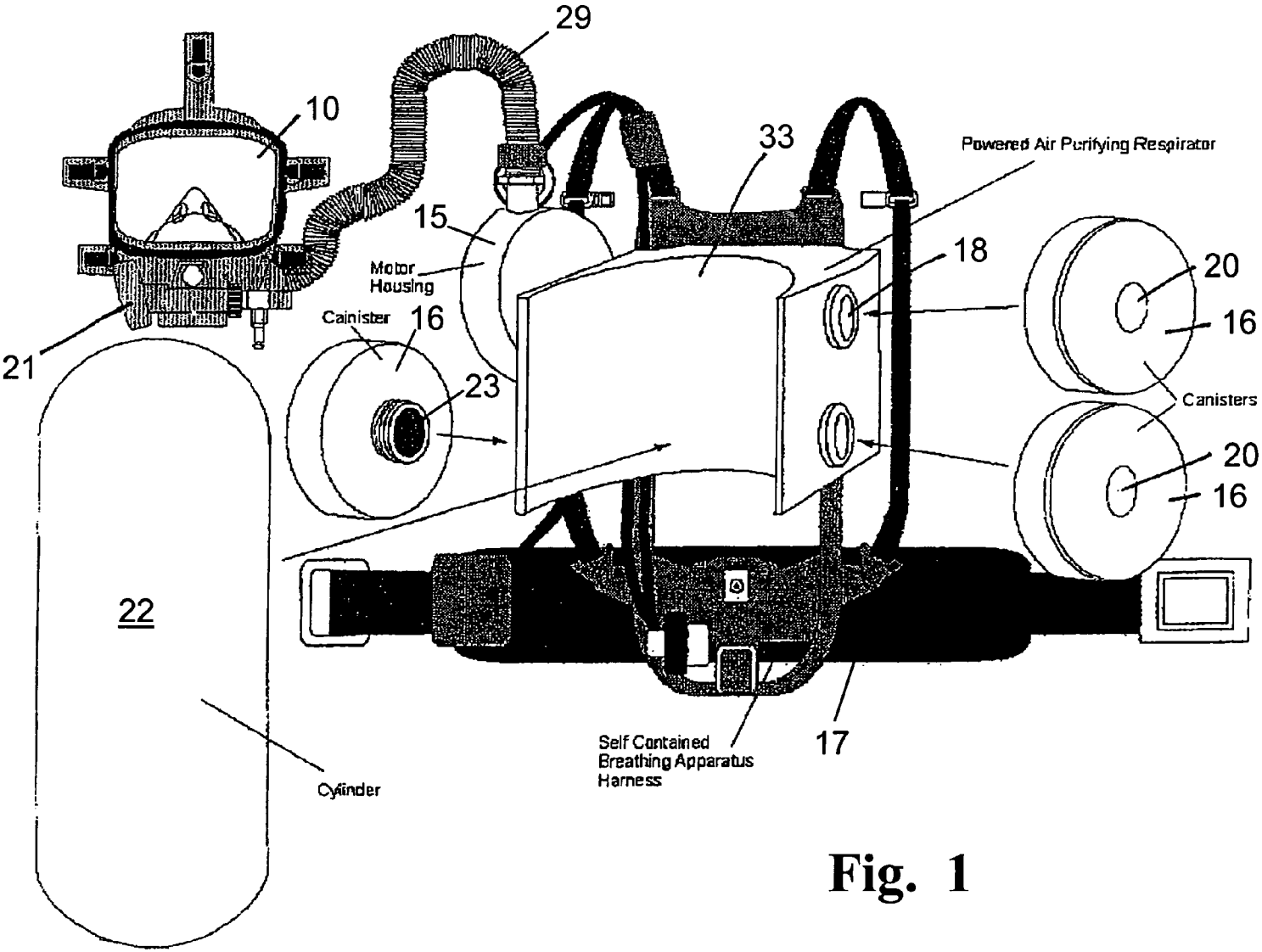
FIG. 1 is an exploded perspective view of an apparatus according to this invention with parts omitted for ease of understanding.
Figure 2:
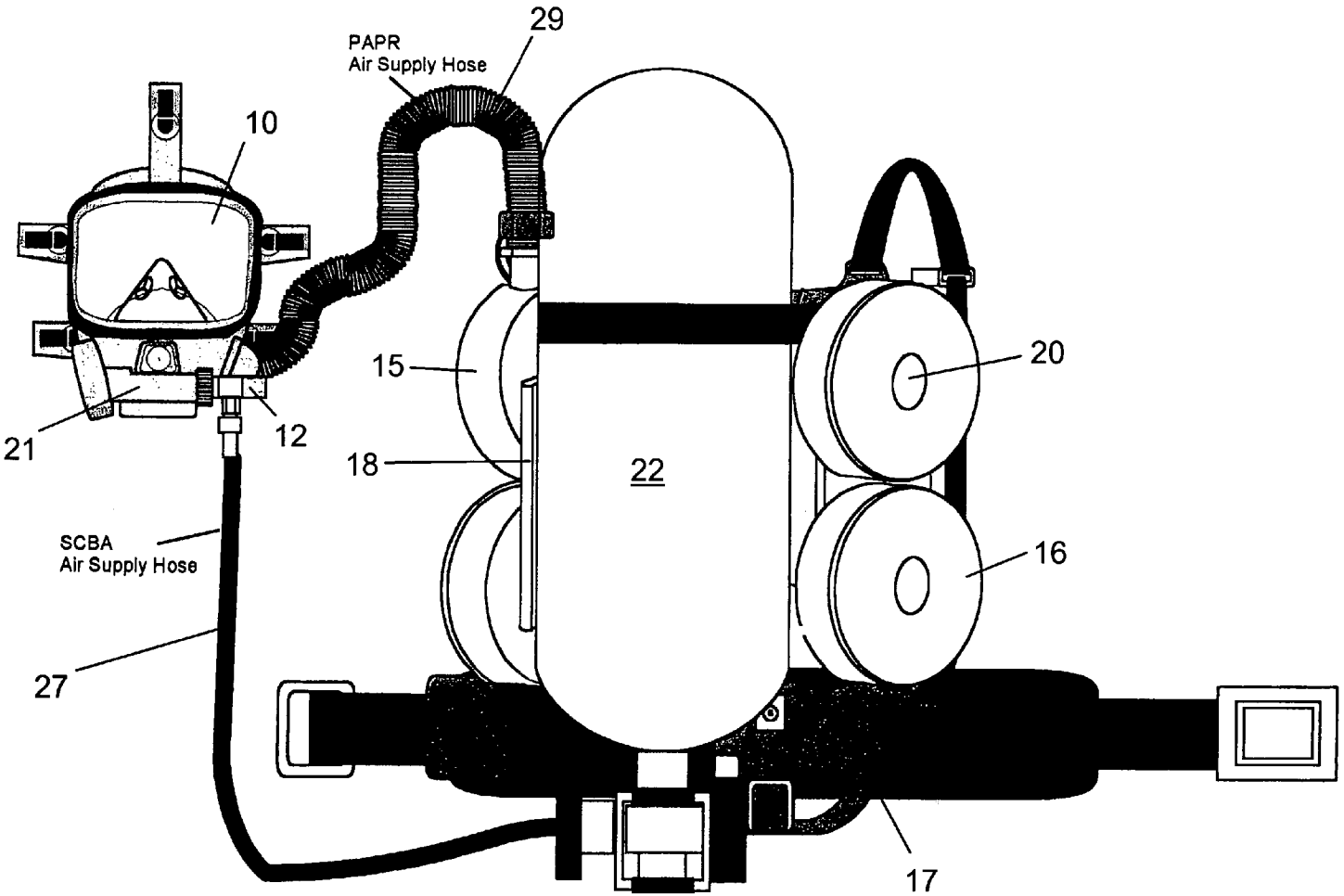
FIG. 2 is a perspective view of one aspect of the apparatus according to this invention in a fully assembled condition.

Referring now to the drawing, there is shown in FIGS. 1 and 2 an apparatus that comprises a facemask 10 that is adapted to be tightly fitted to the face of the wearer against incursion by the ambient atmosphere (for clarity, the user is not shown wearing the mask. Further, for clarity, the alternative mouth and/or nose breathing elements are not shown). A hose 29 connects the facemask 10 directly to source of breathable air, such as air that has been cleaned and is forced into the facemask by means of a blower motor and fan assembly 15. In this embodiment, the facemask 10 is also connected directly to a compressed air bottle 22 via a hose 27, as shown in FIG. 2. Note that in this embodiment, the facemask itself is the plenum chamber into which bottled air as well as cleaned ambient air is forced.

The blower motor and fan assembly 15 is operatively connected to a plenum chamber assembly 18 that has attached to it a plurality of filter elements 16. The impeller of fan 25 is adapted to cause ambient air to be drawn through the filters or canisters (containing suitable decontamination) 16 where the air is to be cleaned of solid particulate matter, harmful gases and/or odors to produce cleaned air 19. Subject to the class of canisters fitted and the time spent in the contaminated area, the canisters 16 may provide breathable air in a chemically, biologically or nuclear contaminated environment.

Figure 6:
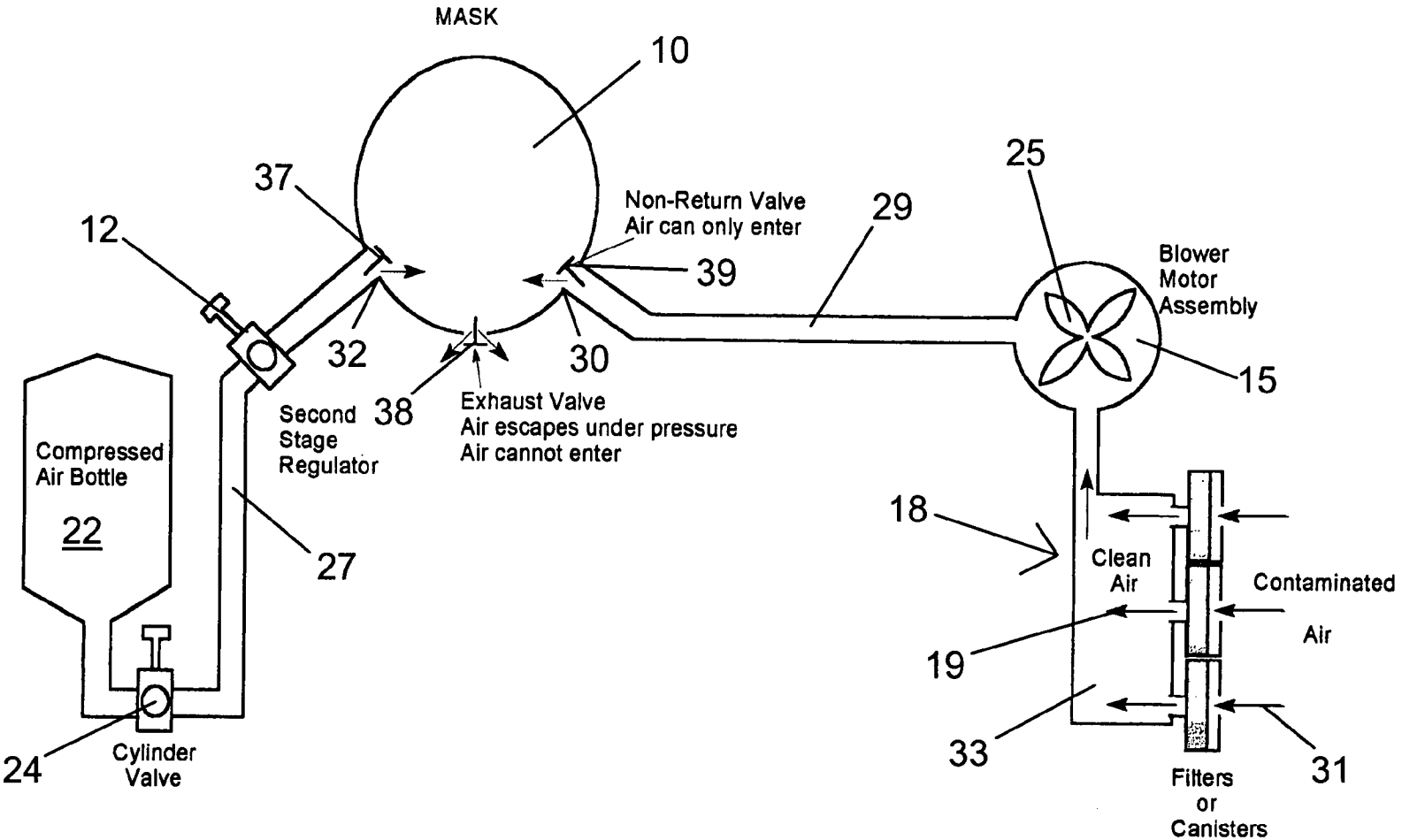
FIG. 6 is a schematic diagram of a fourth embodiment of an air supply system according to this invention.
Figure 7:
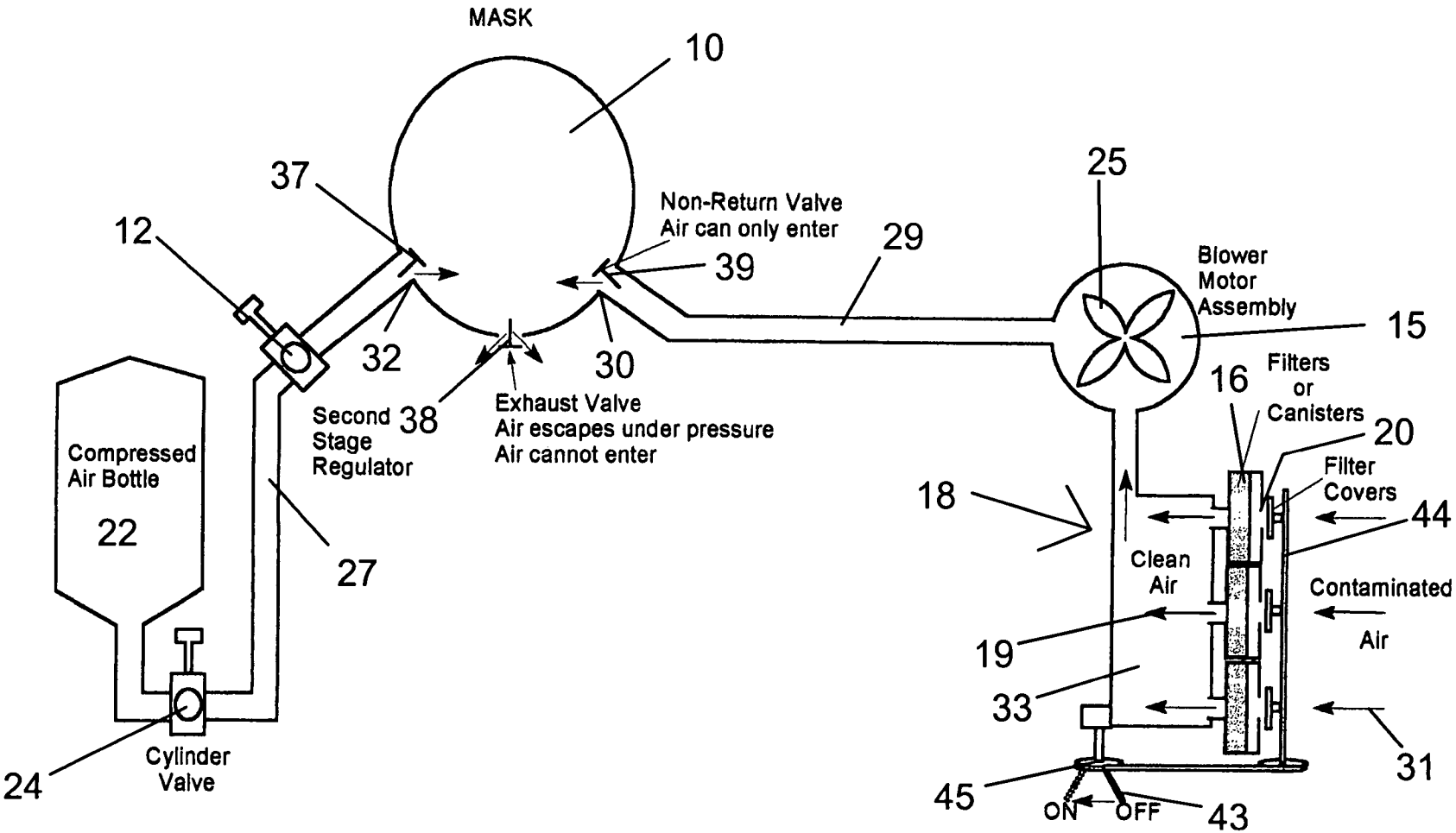
FIG. 7 is a schematic diagram of the fourth embodiment of the invention with some modifications.

The cleaned air 19, which presumably has sufficient oxygen content, is drawn by the fan 25 into operative relationship with the facemask 10 to thereby provide breathable air to the wearer. The cleaned air 19 can be fed directly to the mask 10, as shown in FIGS. 6 and 7, or it can be deployed to the facemask 10 through a second plenum chamber 21 as shown in FIGS. 3, 4 and 5.

Figure 3:
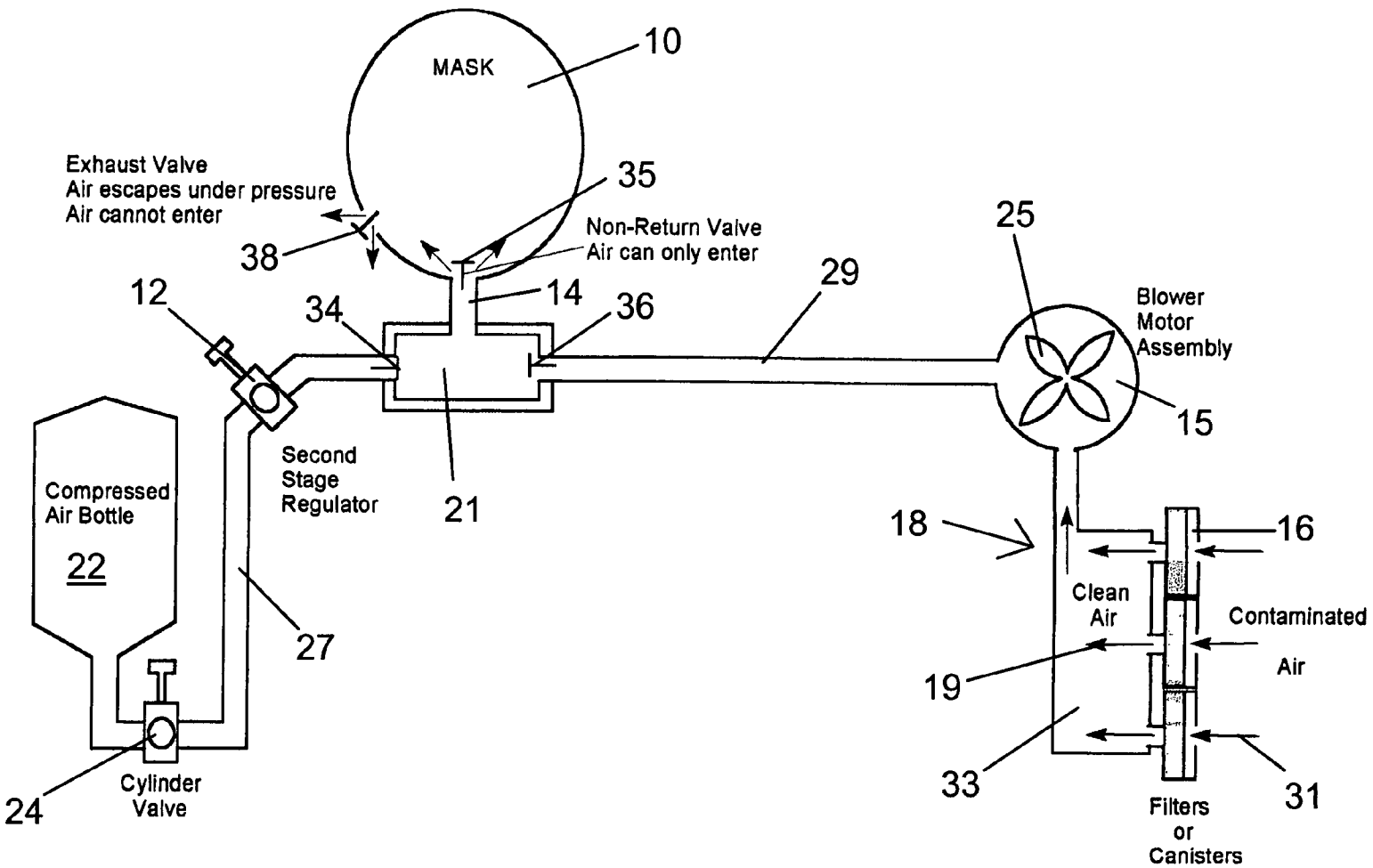
FIG. 3 is a schematic diagram of a first embodiment of an air supply system according to this invention.
Figure 4:
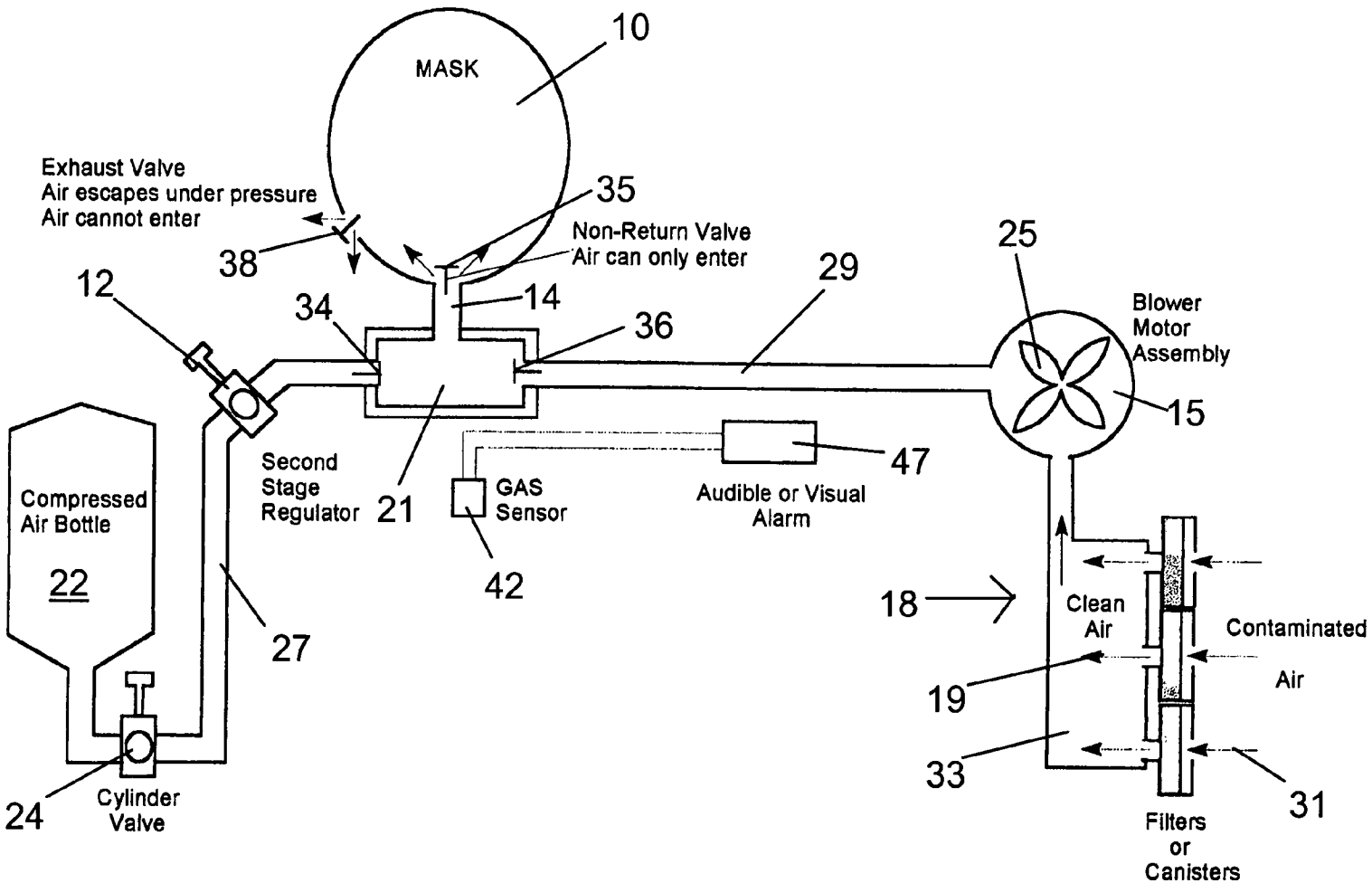
FIG. 4 is a schematic diagram of a second embodiment of an air supply system according to this invention.
Figure 5:
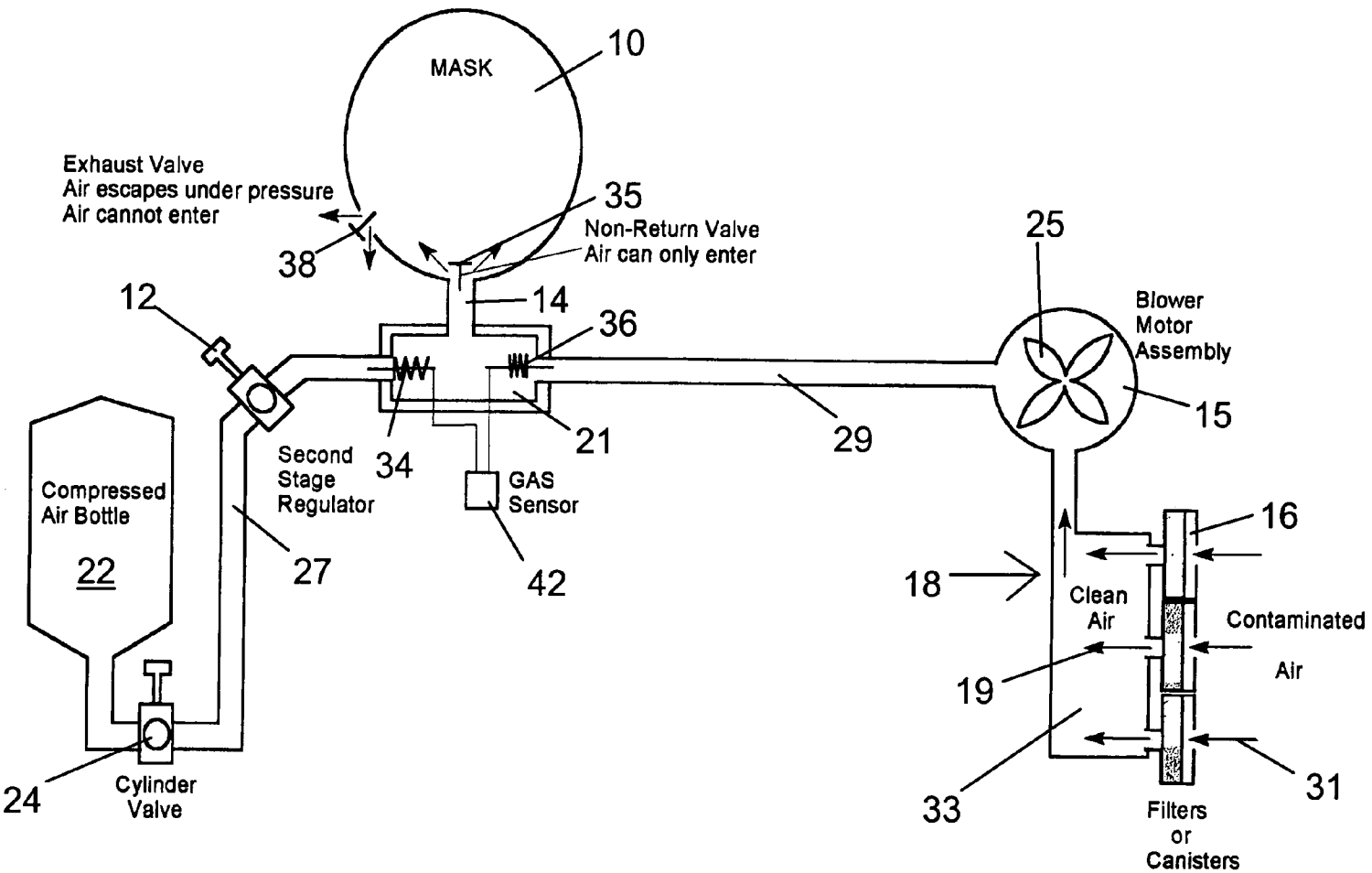
FIG. 5 is a schematic diagram of a third embodiment of an air supply system according to this invention.

Thus, in some embodiments of this invention, shown in FIGS. 3, 4, and 5, the facemask 10 is connected to a plenum chamber 21 via a hose 14. The plenum chamber 21 is adapted to be fed from the air bottle 22 through a hose 27 via a regulator 12 and a shut off valve 24. The plenum chamber 21 is also adapted to be fed purified air 19 from the filters/decontamination canisters 16 through the fan 25 via hose 29. The plenum chamber 21 can be fed with bottled air or purified air in the alternative.

In FIGS. 3, 4, and 5, the facemask 10 is shown to be connected, via a hose 14, to a plenum 21 that in turn, is connected to both a compressed air bottle 22 via hose 27 and a filter/decontamination system via hose 29. The plenum 21 is connected, via a hose 29 through the blower impeller 25, to the plenum chamber 18, thence to filters/decontamination canisters 16 and on to an ambient air intake 31. The air bottle 22 is connected to the plenum 21 via a hose 27, a regulator 12, and a shut off valve 24. The plenum chamber 21 has suitable valves 34 and 36 that are adapted to control the flow of air from either the air bottle 22 or the filter/decontamination canisters 16. The impeller fan 25 provides means for moving ambient air through the intake 31 and through the filter/decontamination canisters 16 into the facemask 10. Valve 35 is a one-way valve on the end of hose 14 that allows air from plenum 21 to enter the facemask 10 but does not permit the air contents of the facemask 10 to flow out of the facemask back into the plenum 21.

The filter/canister plenum chamber 18 supports at least one, and preferably a plurality of filters or canisters 16. The exit from each canister is preferably operatively associated with the openings in the mask plenum 21 so that contaminated air drawn into each filter/decontamination canister 16 by means of the motor and fan assembly 15 is cleaned and then powered by the fan 25 into the facemask 10 via the hose 14 and inlet valve 36.

In the various Figures, there are shown three (3) canisters 16 each of which contain filter medium. One or more of the canisters can also contain suitable materials that serve to decontaminate the ambient environmental air by eliminating harmful components that are not filterable.

The canisters can be assembled, in a preferred embodiment, so that each canister has a separate intake opening 20 and a separate exit 23. All air passing through any and all specific filter decontamination canister(s) exit into a manifold plenum 18, having an air collection chamber 33, that is operatively associated with the fan and motor assembly 15, as stated above. The individual filter/decontamination canisters can be used individually or in plural configuration and may be fitted all on one side of the filter plenum chamber 18 or fitted some one side and some the other to the desired quantity.

The air bottle 22 is assembled into a conventional harness 17 and operatively associated with the mask plenum chamber 21 such that air released from the air bottle 22 bypasses the filter media in the canisters 16 and proceeds directly to the plenum chamber 21 and thence through the hose 14 and valve 35 into the facemask 10. A gas pressure regulator 12 is required for use with the bottled air in order to let the bottle pressure down to a pressure that is manageable by the user.

Another embodiment of this invention, shown in FIG. 6, separates the source of cleaned ambient air from the source of bottled air (suitably supplied from a normal atmosphere) by providing separate access 30 and 32 to the facemask 10. Each of these separate entry points is suitably adapted to be closed by a valve 37 and 39 that are one-way or no return valves. That is, valves 37 and 39 and the air pressure from the source of air supply for the time being, permit air to flow into the facemask 10 but do not permit the air contents of the facemask 10 to flow out of the facemask back into the alternative source of air supply and purification system.

In all the embodiments, there is provided a separate valve 38 that is also a one-way valve that allows the contents of the facemask 10 to vent from the facemask 10 to ambient atmosphere. This venting valve 38 is so designed that it only opens when the gaseous contents of the facemask 10 are at a pressure greater than ambient.

Referring to FIG. 7, a lever handle or rotary handle 43 is connected to filter cover(s) 44 and the motor on/off switch 45. In the semi-automatic or automatic mode, the lever 43 can be solenoid operated. In the motor-off position, the filter cover(s) 44 is disposed over the air intake opening(s) 20 of the filter/decontamination canister(s) 16 thereby preventing any air from entering the filter/decontamination canister(s). This function provides that while the apparatus is operating in a SCBA mode in a contaminated atmosphere, the filter/decontamination canisters are not taking in any contaminated air and therefore are not becoming unnecessarily contaminated. By being linked to the on/off switch 45, this ensures that the filter/decontamination canister(s) airways are open when the PAPR is switched on.

It should be noted that the system described herein can be operated in any of three modes. Under manual control, starting in PAPR mode, the PAPR would be on, the main cylinder valve 24 would be open, the second stage regulator 12 would be closed, valve 34 in the plenum 21 would be closed, and valve 36 would be open due to the pressure of air from the blower motor assembly 15. When the wearer determines that the atmosphere is in danger of becoming un-breathable or contaminated by a challenge greater than what the filter canisters are designed to take, the wearer opens the second stage regulator 12, the resultant air pressure opens valve 34 and air will pass into the plenum 21. The resultant pressure in the plenum 21 will close the valve 36 shutting off air from the PAPR. The wearer will now be breathing only bottled air. The wearer will switch off the power supply to the PAPR blower motor 15.

In semi-automatic or automatic mode, starting in PAPR mode, the PAPR would be on, the main cylinder valve 24 would be open, the second stage regulator 12 would be closed, valve 34 in the plenum 21 would be closed, and valve 36 would be open due to the pressure of air from the blower motor assembly 15. When, by means of sensor 42, it is determined that the atmosphere is in danger of becoming un-breathable or contaminated by a challenge greater than that the filter canisters are designed to take, the system will generate an alarm 47 which instructs the wearer to open the second stage regulator 12. The resultant air pressure opens valve 34 and air will pass into the plenum 21 or, automatic controls in the system will automatically open valve 34, close valve 36, and switch the PAPR off.

In fully automatic mode, starting in PAPR mode, the PAPR would be on, the main cylinder valve 24 would be open, the second stage regulator 12 would be open, valve 34 would be held closed electrically, or electro-mechanically, in the plenum 21, and valve 36 would be open due to the pressure of air from the blower motor assembly 15. When, by means of sensor 42, it is determined that the atmosphere is in danger of becoming un-breathable or contaminated by a challenge greater than that the filter canisters are designed to take, automatic controls in the system will cause valve 34 to open and air will pass into the plenum 21, closing valve 36 and then the PAPR would be switched off.

The invention has been described with references to a preferred embodiment. While specific values, relationships, materials, and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments, as well as certain variations and modifications of the embodiments herein shown and described, will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. In a breathing apparatus of the type having a facemask, a source of breathable gas under pressure, a first conduit operatively leading from said source of breathable gas, a filter system comprising a filter and/or a decontamination medium, a second conduit operatively leading from said filter system, a blower adapted to move air under positive pressure through said filter system and into said second conduit, a third conduit operatively connecting said first and second conduits to said facemask, a valve assembly operatively associated with said first and second conduits, adapted to control the flow of air from said filter system and pressurized gas from said source of breathable gas, such that breathable air is supplied to a user; wherein the improvement comprises:

a sensor adapted to determine whether air emerging from said filter system is safely breathable and comprises at least 19.5% oxygen;

a signal generator operatively associated with said sensor, adapted to generate a signal indicative of whether said air emerging from said filter system is safely breathable and comprises at least 19.5% oxygen; and a controller associated with said valve assembly and adapted to control said blower in order to move ambient air into and through said filter system, said controller further comprising a switch in electronic communication with said sensor, said valve assembly, and said blower, said switch being configured to selectively open and close separate portions of said valve assembly in response to a predetermined reading from said sensor and to selectively start and stop said blower in order to move said ambient air such that said controller may open and/or close said valve assembly or start or stop said blower in order to allow a user to breathe cleaned air or pressurized air.

2. The breathing apparatus as in claim 1 wherein said opening or closing of said valve assembly is in automatic response to said signal.

3. The breathing apparatus as in claim 1 wherein said valve assembly is adapted to substantially immediately completely close off said second conduit when said signal identifies the ambient air as being of Immediate Danger to Life and Health (IDLH).

4. The breathing apparatus as in claim 1 wherein said signal is detectable by said user, and further comprising an operator for opening or closing said valve assembly that is operable manually by said user.

5. The breathing apparatus as in claim 1 wherein said sensor is adapted to determine if the composition of air emerging from said filter system comprises a sufficient amount of oxygen to be safely breathable.

6. The breathing apparatus as in claim 1 wherein said sensor is adapted to determine if the composition of air emerging from said filter system comprises a sufficiently small amount of particulate matter to be safely breathable.

7. The breathing apparatus as in claim 1, further comprising a regulator operatively associated with said source of breathable gas under pressure to enable delivery of said pressurized breathable gas to said user.

8. The breathing apparatus as in claim 1 wherein said filter system is sufficient to trap solid particles in ambient air and/or to enable ambient air in need of cleaning to have a residence time in contact with said decontamination medium that is sufficient to decontaminate contaminating vapors and gases in said ambient air to form cleaned air that is safe to inhale.

9. The breathing apparatus as in claim 1 wherein said blower moves said ambient air from external of said apparatus into operative relationship with said filter/decontamination medium.

10. The breathing apparatus as in claim 1 wherein said blower is electrically powered.

11. The breathing apparatus as in claim 1 further comprising a plurality of filter/decontamination media.

12. The breathing apparatus as in claim 1 wherein said facemask is adapted to establish and maintain a seal with the face of said user so as to isolate at least the nose and mouth of said user from ambient air, and adapted to maintain said seal under conditions of positive pressure within said facemask.

13. The breathing apparatus as in claim 1 wherein said first conduit is disposed in operative relationship to and between said source of breathable gas and said facemask, said second conduit is disposed between said filter system and said facemask, and said valve assembly is adapted to control the flow of cleaned air from said filter system and/or pressurized breathable gas to said facemask.

14. The breathing apparatus as in claim 1, further comprising a plenum chamber operatively associated with said first and second conduits such that cleaned air from said filter system and pressurized gas from said source of breathable gas, respectively, are adapted to flow into said plenum chamber and said third conduit is disposed between said plenum chamber and said facemask.

15. The breathing apparatus as in claim 1, further comprising at least one one-way exhaust valve operatively associated with said facemask and operative when said user exhales whereby increasing the internal pressure in said facemask above the pressure imposed by said powered forcing of ambient air, and above the pressure imposed by gas being fed from said source of breathable gas.

16. The breathing apparatus as in claim 1 wherein said gas in said source of breathable gas comprises air.

17. The breathing apparatus as in claim 1 wherein said pressurized gas comprises oxygen admixed with a substantially inert gas.

18. The breathing apparatus as in claim 1 wherein said source of breathable gas comprises a plurality of containers adapted to contain gas under pressure.

19. The breathing apparatus as in claim 1 wherein said starting or stopping of said blower is in automatic response to said signal.

20. The breathing apparatus as in claim 1 wherein said controller stops said blower in response to said signal and said stopping of said blower is in conjunction with said closing of said valve.

* * * * *